United States Patent [19]

Mason

[11] Patent Number: 4,498,532

[45] Date of Patent: Feb. 12, 1985

[54] PUMP DOWN TOOL AND CHECK VALVE

[75] Inventor: Charles E. Mason, Fairmont, W. Va.

[73] Assignee: Conoco Inc., Ponca City, Okla.

[21] Appl. No.: 485,992

[22] Filed: Apr. 18, 1983

[51] Int. Cl.[3] ..... E21B 23/08

[52] U.S. Cl. ..... 166/70; 166/77; 166/153

[58] Field of Search ..... 166/70, 250, 254, 77, 166/84, 153–156, 325, 332, 385, 322; 175/214, 218, 317, 236; 254/134.4, 134.5; 403/370, 371, 374, 104

[56] References Cited

U.S. PATENT DOCUMENTS

| | | | |
|---|---|---|---|
| 3,104,714 | 9/1963 | Terrel et al. | 166/155 |
| 3,312,282 | 4/1967 | Yetman | 166/77 |
| 3,378,891 | 4/1968 | Metz | 403/371 |
| 3,394,760 | 7/1968 | Childers et al. | 166/155 |
| 3,965,978 | 6/1976 | Conley et al. | 166/113 |
| 4,295,536 | 10/1981 | Jones, Jr. et al. | 175/214 |

*Primary Examiner*—James A. Leppink
*Assistant Examiner*—Thuy M. Bui
*Attorney, Agent, or Firm*—Richard W. Collins

[57] ABSTRACT

A device for use during operation of a borehole survey probe or the like. The device is attachable to a flexible cable which in turn is connected to the survey probe, and the device includes an outer sealing or swab member and an interior valve. The valve and sealing member cooperate during pumping of the survey probe down through a conduit, and the valve opens during retrieval of the survey probe so that fluid in the conduit passes through the device as the survey probe is removed.

3 Claims, 6 Drawing Figures

PUMP DOWN TOOL AND CHECK VALVE

BACKGROUND OF THE INVENTION

1. Field of the Invention

This invention relates to drilling generally horizontal boreholes in subterranean formations such as coal seams, and more particularly to a device which facilitates pumping a survey probe into a borehole and removing it therefrom.

Coal seams often contain methane gas in amounts which affect the safety of a mining operation. One method of alleviating the methane gas problem is to drill one or more boreholes into the seam in advance of mining, and to produce gas through the borehole until the methane gas level is low enough to permit safe mining. It is essential in such an operation to maintain the borehole within the coal seam, and techniques have been devised to provide this capability. One such technique utilized a survey probe which contains instrumentation capable of providing information regarding the borehole position. Such probes are periodically pumped down the interior of the drill string to a position adjacent the drill bit, readings are taken, and the survey probe is then removed from the drill string. If necessary, adjustments are made in the drilling operation, based on the information obtained, to maintain the borehole within the coal seam.

2. The Prior Art

The operation in which the present invention is applicable is described in detail in U.S. Pat. No. 4,295,536 which describes a method for periodically running an instrumented survey probe through a conduit to obtain information about a borehole being drilled. The present invention is intended for use in a similar operation.

Wireline retrievable tools having check valves for enabling fluid in a conduit to bypass the tool are known, and one such device is described in U.S. Pat. No. 3,965,978. The device described therein differs from the device according to the present invention in that it does not have a sealing member between the tool and the conduit, and the wireline connected thereto does not extend through the valve portion to a probe downstream thereof.

The present invention is particularly suited for use in connection with a pumpable instrument survey probe in connection with drilling generally horizontal boreholes as described in the aforementioned U.S. Pat. No. 4,295,536.

SUMMARY OF THE INVENTION

According to the present invention, a valve and sealing device are provided for attachment to a cable connector which in turn is connected to a survey probe which is to be pumped down through a drill string conduit. The valve and sealing device is comprised of a valve having a slidable piston therein and a sealing swab extending outwardly from the valve housing. A cable extends through the valve to a connector joining the valve to a survey probe, and the cable is adapted to move longitudinally with the valve piston in the valve. The valve and cable are connected to a survey probe. The valve and sealing device is pumped through the conduit, forcing the survey probe ahead of it, and then is retrieved with the valve portion in the open position to reduce resistance from fluid in the conduit.

DESCRIPTION OF THE PREFERRED EMBODIMENT

The preferred embodiment of the invention will be described with reference to the drawings.

Figures 1, 2, 3, 4:
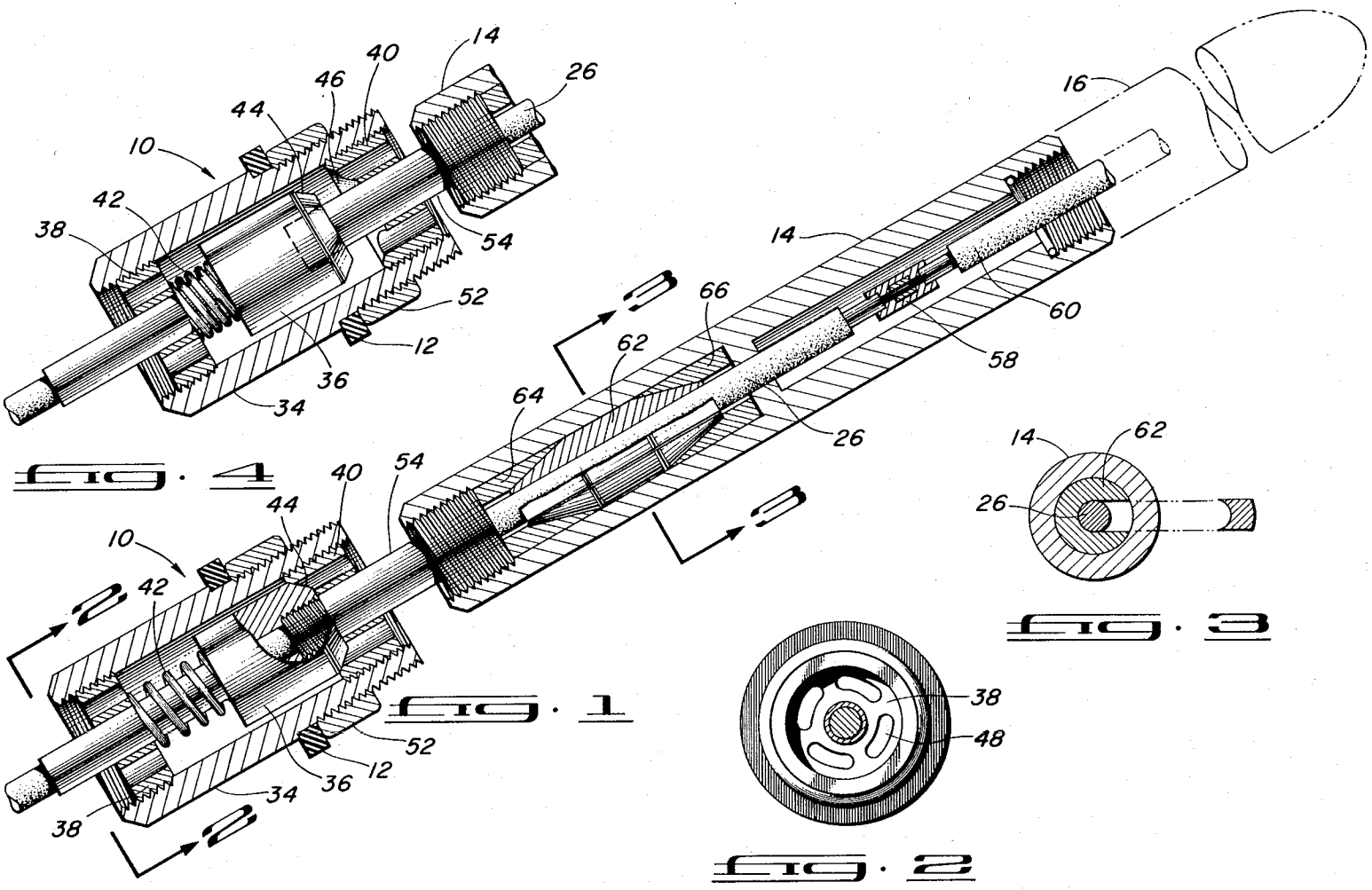
FIG. 1 is a side elevation, partially cut away, showing the valve and sealing device of the invention attached to a connector which includes a cable clamp and which is connected to an instrument probe.
FIG. 2 is a view taken along the line 2—2 of FIG. 1.
FIG. 3 is a cross-section, partially expanded, taken along the line 3—3 of FIG. 1.
FIG. 4 is a side elevation, partially cut away, showing the valve in its open or retrieval position.
Figure 5:
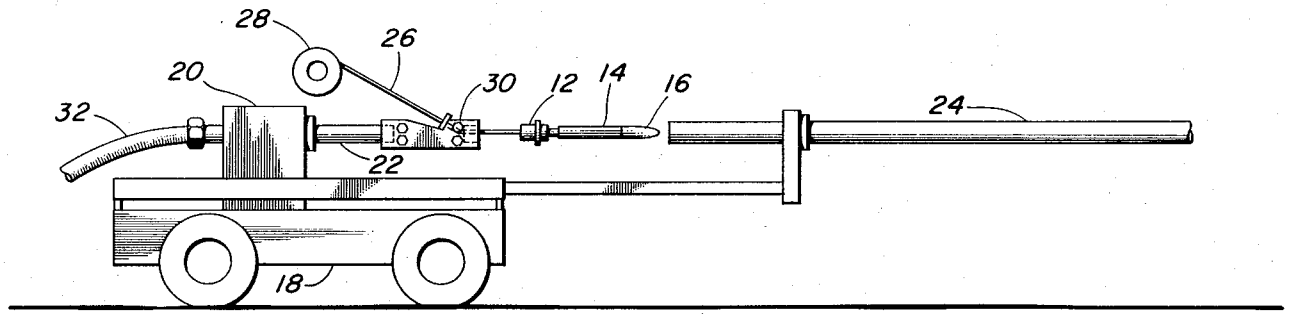
FIG. 5 is a side elevation showing the valve and sealing device in position to be inserted into a drill string.
Figure 6:
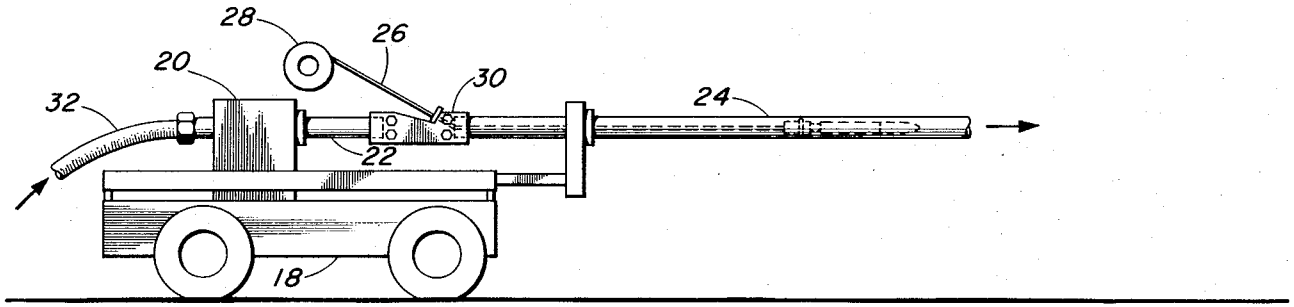
FIG. 6 is a side elevation showing the valve and sealing device in the pump-in mode.

FIGS. 1 and 4 show a valve 10 carrying a sealing swab 12. The valve is attached to connector housing 14 which in turn is attached to instrument survey probe 16. As shown in FIGS. 5 and 6, a vehicle 18 carries a drill motor 20 having a rotating drill pipe section 22 which attaches to drill string 24 during normal drilling operations.

The position or trajectory of a borehole being drilled is periodically checked by pumping an instrumented survey probe 16 down the hole. The probe is connected by cable 26 which provides a return path for signals from the probe, and which also is used to retrieve the probe after readings are obtained. The cable is stored on reel 28 and passes through a split cable seal 30 as described more fully in U.S. Pat. No. 4,295,536.

In accordance with the invention, valve 10, swab 12 and connector housing 14 are attached to probe 16, and the entire connected assembly is inserted into drill string 24 as shown in FIG. 5. Drill string 24 is then connected to cable seal 30 as shown in FIG. 6, and fluid from hose 32 is pumped through pipe 22 into drill string 24, forcing the assembly down the drill string 24 as shown in FIG. 6. After the assembly is near the end of drill string 24, measurements regarding the position and trajectory of the borehole are taken, and the assembly is then retrieved by winding cable 26 onto reel 28.

The present invention is primarily directed to improving the pumping in and retrieving of the probe. To this end, the valve, swab and connector housing as exemplified in FIGS. 1–4 are utilized. As best seen in FIG. 1, valve 10 includes an outer valve housing 34 including a piston 36 slidable therein. A rear stop member 38 and a front stop member 40 are threaded into valve housing 34, and a spring 42 biasing piston 36 to the forward position is provided. Piston 36 includes a tapered front surface 44 which matches tapered valve seat surface 46 in front stop member 40. Front stop member 40 and rear stop member 38 have openings 48 formed therein.

The swab 12 (FIGS. 1 and 4) is retained on valve housing 34 by retaining nut 52.

A connector stub 54 is threaded into piston 36 and connector housing 14 (FIG. 1), and connector housing 14 is in turn connected to probe 16. Cable 26 extends through valve 10, piston 36, connector stub 54 and into connector housing 14, where it is joined by cable connector 58 to probe cable 60 inside connector housing 14.

Cable 26 is sealingly clamped within connector housing 14 by means of a split clamp 46 (FIGS. 1 and 3) which grips cable 26 by virtue of the action of tapered end clamp rings 64 and 66. These end clamp rings force clamp member 62 against cable 26 in response to tightening of connector stub 54 in connector housing 14 (FIG. 1). With clamp 62 tightened against cable 26, the entire assembly including valve 10, swab 12, connector stub 54, connector housing 14 and probe 16 will move together as a unit when the assembly is being pumped down or retrieved from drill string 24.

OPERATION OF THE PREFERRED EMBODIMENT

The operation of the invention will now be described with reference to the drawings.

The entire assembly including the valve 10, swab 12, connector stub 54, connector housing 14 and probe 16 is first positioned as shown in FIG. 5 for insertion into drill string 24. The assembly normally is inserted by hand. After the assembly is in the drill string, the drill string is connected to cable seal 30, and drilling fluid from hose 32 is pumped into drill string 24 behind the assembly. The action of the fluid, with assistance from spring 42 (FIG. 1) causes valve piston 36 to move forward against front stop 40 (FIG. 1), thereby closing valve 10 to flow of fluid therethrough. Swab 12 sealingly engages the inner surface of drill string 24 preventing flow of fluid past the outside of valve 10. As result of the action of valve 10 and swab 12, continued pumping of fluid into drill string 24 causes the assembly to move down through the drill string.

After the assembly is in position for obtaining measurements, the pump is stopped, and information is gathered. After readings have been obtained, the assembly is retrieved by rewinding cable 26 onto reel 28. Pulling on cable 26 causes piston 36 to move back to the rear or open position as shown in FIG. 4. In this position, fluid in the drill string can bypass the valve 10 through openings 48 in the front and rear stop members, enabling the assembly to be retreived without having to move the entire column of fluid in the drill string.

The foregoing description of the preferred embodiment of the invention, and the operation thereof, is intended to be illustrative rather than limiting of the invention, which is to be defined by the appended claims.

I claim:

1. A device for use in pumping an instrument probe through a conduit, and in retrieving said probe from said conduit, said device comprising:

(a) a valve housing having a flow passage therethrough;

(b) a swab member extending from the exterior of said valve housing and adapted to prevent fluid flow between said valve housing and said conduit;

(c) a valve piston axially movable within said housing, (d) front and rear stop members in said valve housing, said front stop member including valve seat means formed therein which prevents flow of fluid therethrough when said valve piston is seated thereagainst;

(e) a flexible cable extending through said valve housing, said flexible cable being connected to a probe cable extending from said probe, and said flexible cable being adapted to move longitudinally with said valve piston in said valve; and (f) connector means including a connector housing, said connector housing including clamp means therein for gripping said flexible cable, said connector housing further enclosing cable connector means for joining said flexible cable and said probe cable, and said connector housing being attached to said valve piston by a connector stub threaded into said piston and said connector housing.

2. The device of claim 1 including spring means biasing said valve piston away from said rear stop member and toward said front stop member.

3. The device of claim 1 wherein said clamp means includes a split clamp member through which said cable passes, and tapered end clamp rings at each end of said split clamp member, said tapered end clamp rings being adapted to compress said split clamp member against said cable when said connector stub is threaded into said connector housing.

* * * * *